US008062009B2

(12) United States Patent
Cueni

(10) Patent No.: US 8,062,009 B2
(45) Date of Patent: Nov. 22, 2011

(54) DEVICE FOR FIXING A TUBE FOR PERISTALTIC CASSETTE

(75) Inventor: Reto Cueni, St-Prex (CH)

(73) Assignee: SMC—Swiss Medical Care S.A., Lausanne (CH)

( * ) Notice: Subject to any disclaimer, the term of this patent is extended or adjusted under 35 U.S.C. 154(b) by 518 days.

(21) Appl. No.: 11/662,333

(22) PCT Filed: Aug. 20, 2005

(86) PCT No.: PCT/IB2005/053093

§ 371 (c)(1),
(2), (4) Date: Mar. 8, 2007

(87) PCT Pub. No.: WO2006/033076

PCT Pub. Date: Mar. 30, 2006

(65) Prior Publication Data

US 2008/0069711 A1 Mar. 20, 2008

(30) Foreign Application Priority Data

Sep. 23, 2004 (CH) ..... 1559/04

(51) Int. Cl.
*F04B 43/12* (2006.01)
*F04B 45/06* (2006.01)

(52) U.S. Cl. ..... 417/477.9; 417/474; 417/476; 417/477.1

(58) Field of Classification Search .. 417/477.1–477.14, 417/474

See application file for complete search history.

(56) References Cited

U.S. PATENT DOCUMENTS

| | | | | |
|---|---|---|---|---|
| 3,674,383 | A * | 7/1972 | Iles | 417/476 |
| 4,274,409 | A * | 6/1981 | Bush | 604/153 |
| 5,342,181 | A | 8/1994 | Schock et al. | |
| 6,494,693 | B1 | 12/2002 | Sunden | |
| 7,074,021 | B2 * | 7/2006 | Byrne | 417/477.2 |
| 2004/0073177 | A1 * | 4/2004 | Hickle | 604/257 |

FOREIGN PATENT DOCUMENTS

| | | | |
|---|---|---|---|
| EP | 1 048 848 | A | 11/2000 |
| GB | 769 789 | A | 3/1957 |
| WO | WO 03/097156 | A | 11/2003 |

OTHER PUBLICATIONS

International Search Report mailed Dec. 15, 2005 in PCT/IB2005/053093.

English translation of International Preliminary Report on Patentability—mailed in corresponding PCT Appln. No. PCT/IB2005/053093.

* cited by examiner

*Primary Examiner* — Charles Freay
*Assistant Examiner* — Christopher Bobish
(74) *Attorney, Agent, or Firm* — Nixon & Vanderhye P.C.

(57) ABSTRACT

The invention concerns a peristaltic cassette casing comprising a tube housing forming an arc, characterized in that it comprises tube fixing means arranged along said housing so as to prevent the longitudinal displacement of a tube arranged in said housing.

4 Claims, 7 Drawing Sheets

Graph 1 : Conventional Cassette

Graph 2 : Conventional Cassette

Graph 3 : Cassette with bonded tube

Graph 4 : Cassette with bonded tube

DEVICE FOR FIXING A TUBE FOR PERISTALTIC CASSETTE

This application is the US national phase of international application PCT/IB2005/053093 filed 20 Sep. 2005 which designated the U.S. and claims benefit of CH CH 01559/04, dated 23 Sep. 2004, the entire content of which is hereby incorporated by reference.

FIELD OF THE INVENTION

The field of the present invention is that of medical peristaltic systems.

The invention relates more specifically to peristaltic cassettes.

PRIOR ART

A peristaltic cassette system comprises a case containing a housing designed to accommodate rollers and a length of tube.

Operating a peristaltic cassette requires a sufficient compressive force by the rollers on the tube to seal off the volume of liquid between two rollers. This force, combined with the rotation of the rollers about the drive shaft, can cause lengthwise slippage of the tube along the housing inside the case.

This slippage is difficult to control because it is highly dependent on the coefficients of friction between roller and tube, and between tube and case.

This lengthwise slippage of the tube inside the cassette case causes elongation of the tube upstream and in the active part of the cassette, with the following consequences on the performance of the peristaltic cassette:

- A reduction in the compressive force of the rollers causing premature leaks (due to the reduction in the thickness of the walls of the tube);
- A fall-off in the flow rate (due to the reduction in the volume of the entrance chamber, which in turn is the result of the reduction in the width of the chamber and its premature closure by the roller).

Other undesirable effects on the operation of the cassette are also observed, such as an increase in the driving torque, premature tube wear, noise, and stability.

The present invention greatly reduces or even eliminates the abovementioned problems.

The invention is characterized in that the case comprises tube fixing means along the tube housing to prevent longitudinal movement of a tube arranged in said housing. It is also characterized in that the tube fixing means are able to withstand a pressure of more than 2 bar. Having it able to withstand such a pressure considerably limits the traction that the tube could exert on parts of the peristaltic cassette, such as clips.

Other means of fixing the peristaltic tube can be envisaged. Non-restrictive examples that may be cited are adhesive bonding, the use of an injection-molded profiled tube, welding, vulcanization, or fusion of material (e.g. by ultrasound).

The adhesive bonding and use of a profiled tube are described in more detail below by means of the following figures:

FIGS. 1*a* and 1*b* show two separate views of an open cassette case before bonding;

Figure 1A:
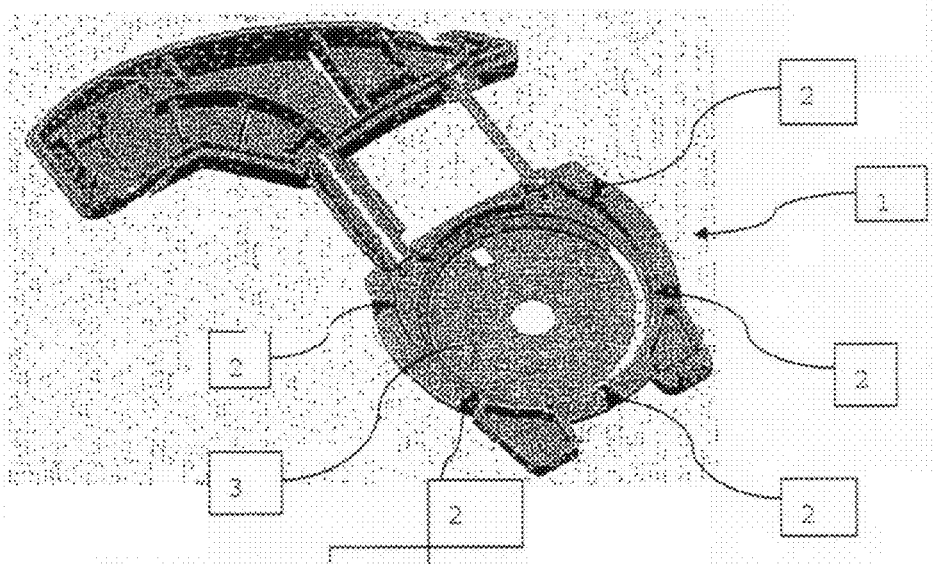
Figure 1B:
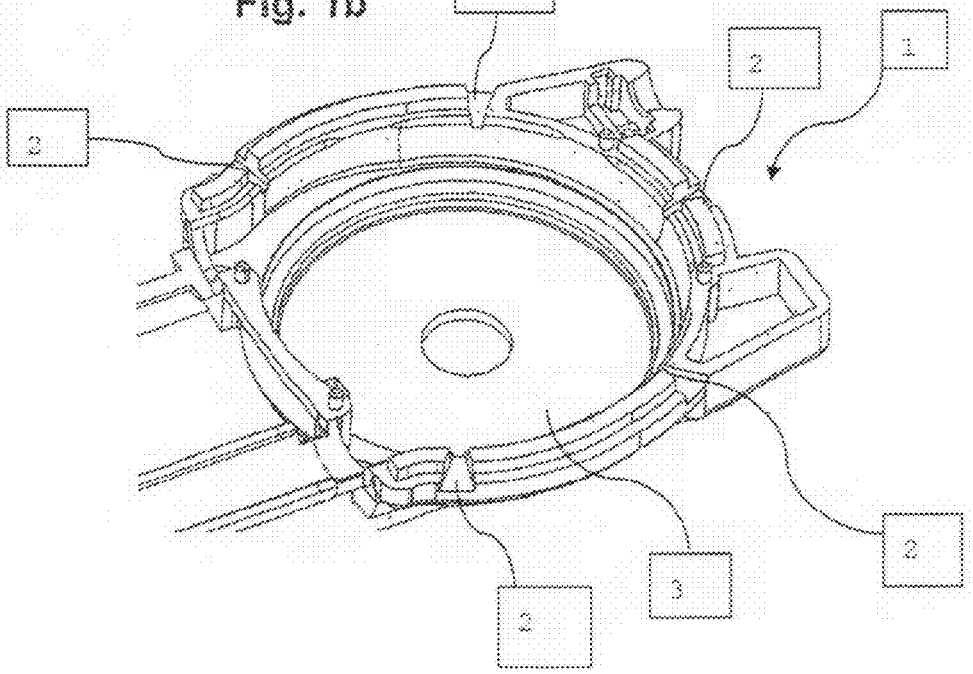

As can be seen in FIGS. 1*a* and 1*b*, the case 1 of the cassette includes five cells around the race 3 defining five locations at which the tube 4 may be bonded to the case 1. There are five corresponding openings 2 for the introduction of the adhesive.

Figure 2:
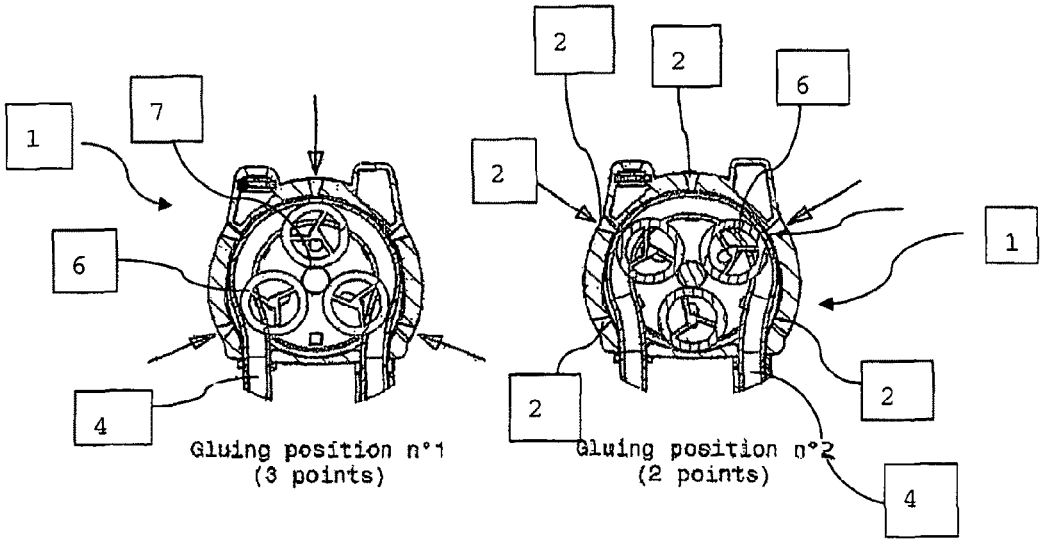
FIG. 2 illustrates the different bonding positions.

Bonding is performed in two steps, case 1 closed, with the rollers 6 and the drive shaft 7 keeping the tube 4 in position and held firmly against the case 1 (see FIG. 2).

This bonding also has the effect of securing together the two case halves of the cassette.

Figure 3:
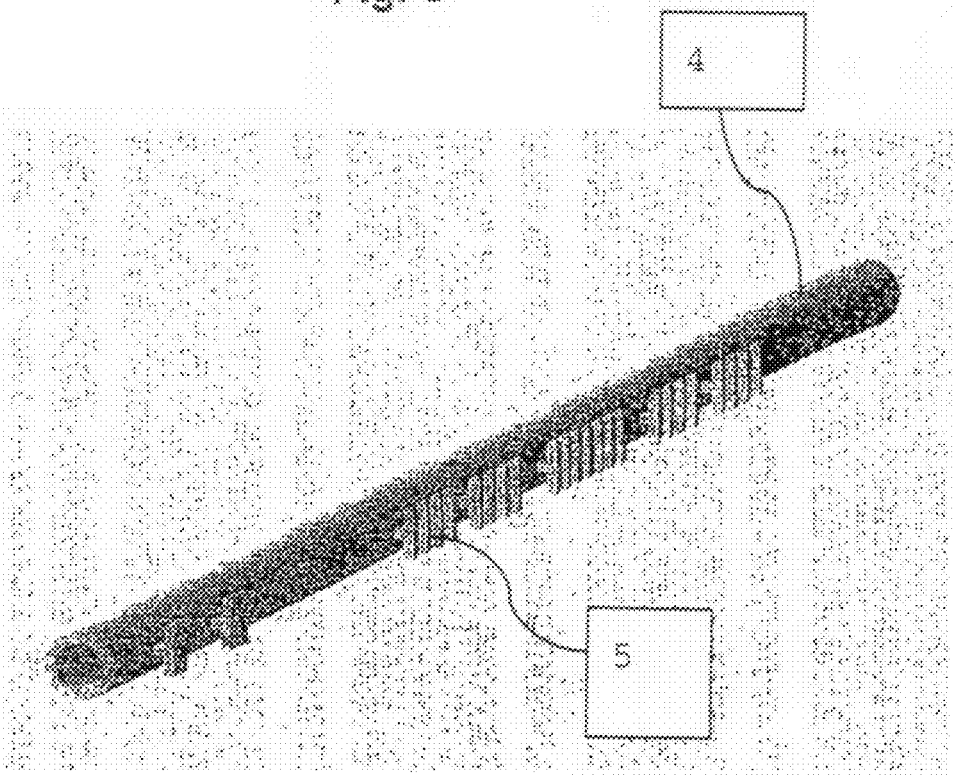
FIG. 3 shows a profiled tube.
Figure 4:
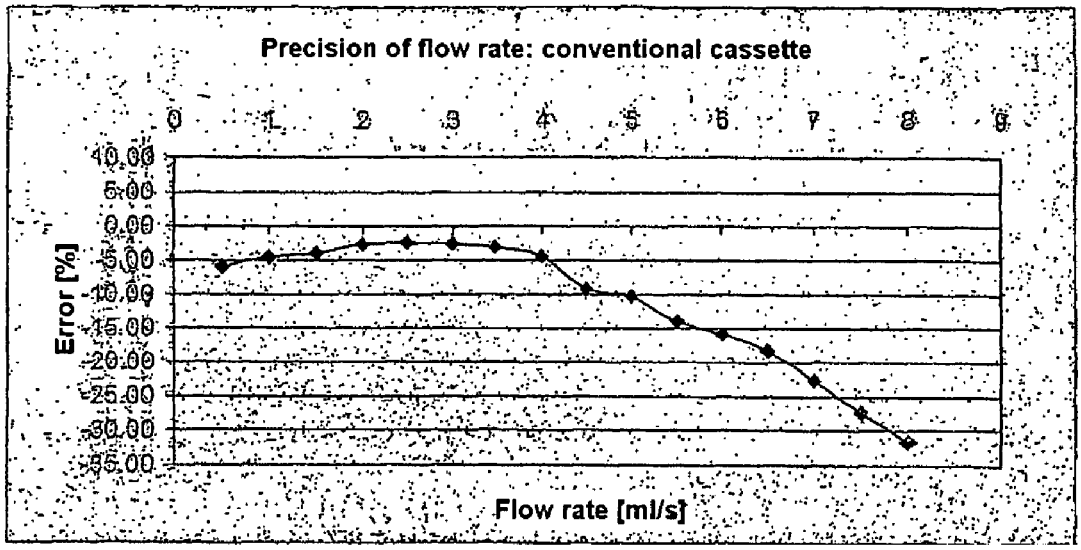
FIG. 4 is a graph showing the flow-rate precision of a conventional cassette in operation.
Figure 5:
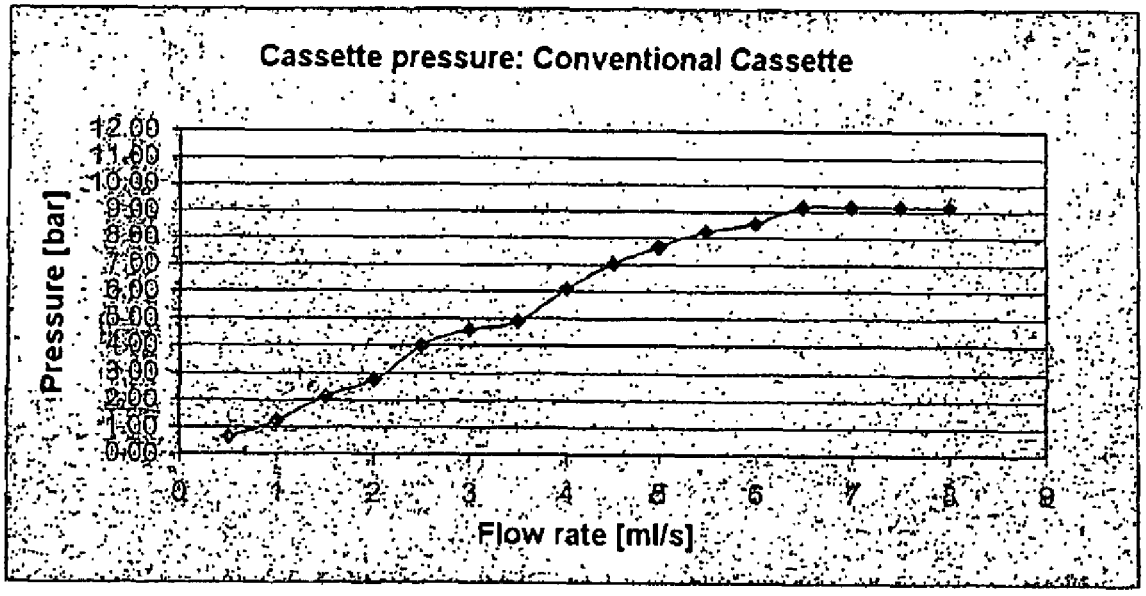
FIG. 5 is a graph showing the precision of a conventional cassette in operation.
Figure 6:
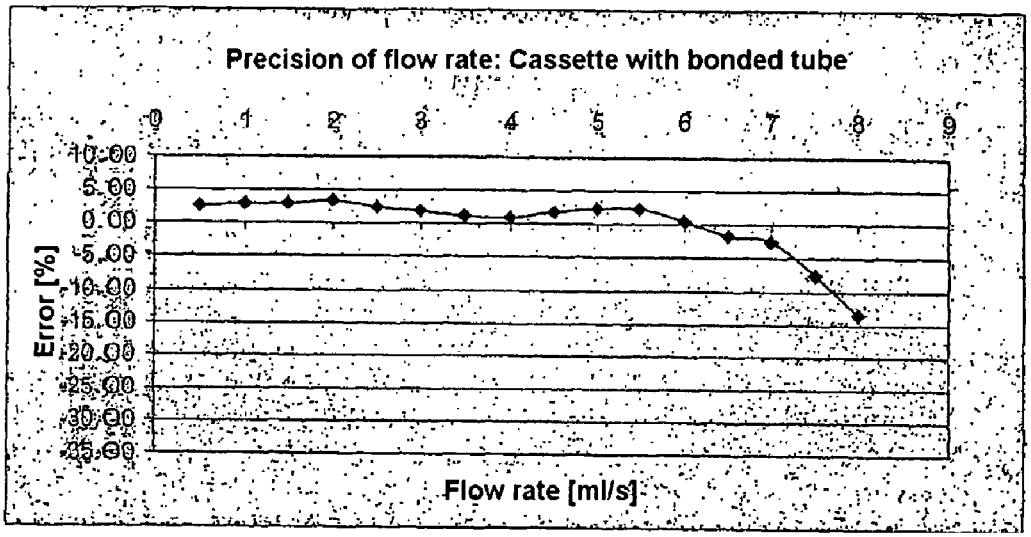
FIG. 6 is a graph showing the precision of flow rate of a cassette in operation with a bonded tube.
Figure 7:
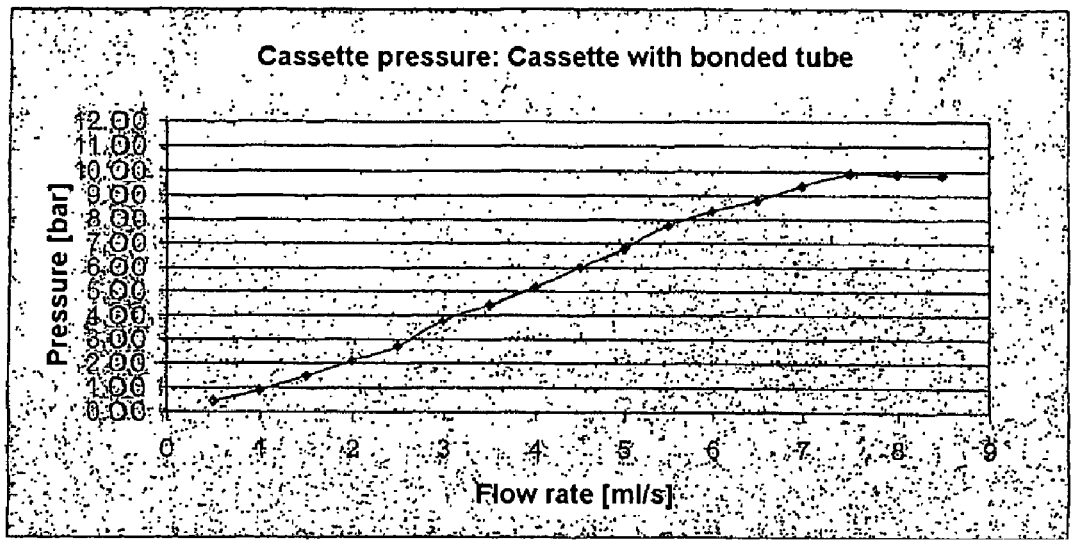
FIG. 7 is a graph showing the pressure of a cassette in operation with a bonded tube.

Another way of fixing the tube 4 to the cassette case is to give the tube a profile 5 having a longitudinal section, which may or may not be cut, such that it can be gripped and so fixed between the two case halves of the cassette (see FIG. 3).

The invention has been tested on a cassette using adhesive bonding of the tube. An initial series of preliminary tests found a marked improvement in performance as shown by the output flow-rate and pressure curves seen in graphs 1-4.

It goes without saying that the invention is not limited to the abovementioned tube fixing means and that it encompasses any fixing means capable of producing the desired effect.

The invention claimed is:

1. A peristaltic cassette case for use with a peristaltic tube having two open ends and having closed side portions between the two open ends, wherein the case comprises:

a tube housing forming an arc of a circle, and a plurality of tube fixing elements arranged along said tube housing to prevent longitudinal movement of the peristaltic tube to be arranged in said housing, said tube housing having an interior and an exterior, said tube fixing elements being able to withstand a pressure of more than 2 bar, and each of said tube fixing elements comprises a cavity capable of holding a quantity of adhesive, wherein each cavity forms a passage connecting the interior and exterior of the tube housing, and wherein each cavity is directed toward a location in the tube housing where a closed side portion of a peristaltic tube to be arranged will reside.

2. A case according to claim 1 comprising two case halves, wherein at least part of an area of contact of the two case halves is around said housing, said tube fixing elements being arranged so as to also have the effect of securing together the two case halves.

3. A case according to claim 2 comprising an actual peristaltic tube with a profile having a longitudinal section, which may or may not be cut, such that the tube can be gripped and so fixed between the two case halves of the cassette.

4. A peristaltic cassette comprising:

a peristaltic case having an exterior and an interior, an arched peristaltic tube race in the interior of the peristaltic case, a plurality of openings in the peristaltic case, each of said plurality of openings extends radially outward from the arched peristaltic tube race, and each of said plurality of openings extends from the interior to the exterior of the peristaltic case, each of said plurality of openings is specifically designed to receive adhesive to adhesively bond closed side portions of a peristaltic tube to be arranged in the arched peristaltic tube race, and each of said plurality of openings is directed toward the interior of the peristaltic case where the closed side portions of the peristaltic tube to be arranged in the arched peristaltic tube race will reside.

* * * * *